United States Patent [19]

Melfi

[11] Patent Number: 4,605,090

[45] Date of Patent: Aug. 12, 1986

[54] CONCRETE NOISE BARRIER

[75] Inventor: Nicholas W. Melfi, Manlius, N.Y.

[73] Assignee: Concrete Pipe and Products Corp., East Syracuse, N.Y.

[21] Appl. No.: 791,054

[22] Filed: Oct. 24, 1985

[51] Int. Cl.[4] ..... E04H 17/00

[52] U.S. Cl. ..... 181/210; 181/284

[58] Field of Search ..... 181/210, 284, 287; 405/272, 277, 284, 285; 52/282, 780

[56] References Cited

U.S. PATENT DOCUMENTS 4,160,491 7/1979 Matsumoto et al. ..... 181/284

4,215,765 8/1980 Harris ..... 181/287

4,402,384 9/1983 Smith et al. ..... 181/210

*Primary Examiner*—Benjamin R. Fuller

*Attorney, Agent, or Firm*—Bruns and Wall

[57] ABSTRACT

A post and panel type noise barrier fence is formed of a plurality of concrete vertical posts or columns which have grooves to hold flat concrete panels between successive ones of the columns. The panels can have a stepped lower edge to accommodate elevational changes in the terrain. Also, certain of the columns have oppositely disposed recesses angled from each other so as to accommodate directional changes at the columns in the direction of the barrier fence.

10 Claims, 3 Drawing Figures

CONCRETE NOISE BARRIER

BACKGROUND OF THE INVENTION

This invention relates to the control of noise pollution, and is more particularly directed to a post-and-panel noise barrier of the type that is employed along highways and at airports to contain or confine loud noises and reduce the noise level in adjacent residential areas.

Several fence-type noise barriers have been previously proposed which employ upright posts having troughs on grooves disposed on opposite faces and in which the edges of boards or panels fit into the troughs or grooves. In these previous noise barrier systems, the boards or panels have straight edges, and they form a tight fit with the troughs or grooves of the associated posts. Consequently, the previous noise barrier systems have not been particularly well adapted for use on terrain where a change in direction is required, either vertically or horizontally, in the layout of the noise barrier.

In order to accommodate rolling terrain or roadway curves, the previous noise barrier systems have had to use wood construction, and have been unable to employ pre-cast concrete.

OBJECTS AND SUMMARY OF THE INVENTION

Accordingly, it is an object of this invention to provide a post-and-panel noise barrier system suitable for use, e.g., along highways and over virtually any terrain.

It is another object to provide such a noise barrier system in which the columns and panels are pre-cast of reinforced concrete.

To satisfy these and other objects, a post-and-panel highway-type noise barrier has a plurality of flat reinforced concrete panels and a plurality of reinforced concrete posts or columns, each having a pair of generally oppositely disposed longitudinal grooves or recesses, and each slightly wider than the thickness of the panels, such that the panels are mounted with their side edges in the cooperating grooves or recesses of successive upright columns. In at least certain ones of the panels, the top or the bottom edge is formed with a step or offset such that one portion of the edge adjacent the step is lower than the abutting portion of that edge. Most favorably, the step is located at the midpoint of the top or bottom edge, and the panels are stacked two high, or more, between pairs of columns, with a stepped top edge of a lower panel mating with a stepped bottom edge of an upper panel. In preferred embodiments of the invention, the longitudinal grooves or recesses of the columns permit an angular offset, or rotation, of the panels of about 10 degrees on either side of a dead-center or undeflected orientation. For changes in direction of about 20 degrees or more, the columns have their oppositely-disposed recesses offset from each other by an appropriate angular offset amount.

The above and many other objects, features, and advantages of this invention will become apparent from the ensuing detailed description of a preferred embodiment of the invention, which is offered by way of example and without limitation, and which is to be read in connection with the accompanying drawings.

DETAILED DESCRIPTION OF A PREFERRED EMBODIMENT

Figure 1:
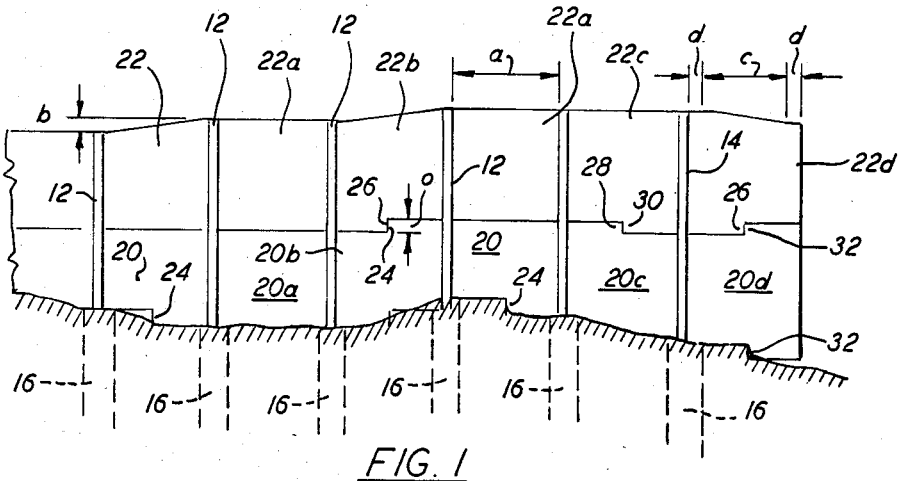
FIG. 1 is a front elevation of a noise barrier fence system according to a preferred embodiment of this invention.

With reference to the drawings, FIG. 1 is a side elevational view of a highway noise barrier fence 10 according to an embodiment of this invention. The fence 10 includes a number of vertical columns or posts 12 adapted for straight fence sections, and can include one or more columns 14 to provide for bends in the layout of the fence 10. The columns 12 and 14 are anchored in piers 16, shown here in ghost line, extending beneath the soil surface. The columns or posts 12 and 14 penetrate a significant fraction of their length below the ground surface, and are able to sustain road vibrations and other environmental forces that are often encountered along roadways.

Between each pair of columns 12, 14 are fitted flat concrete lower panels 20 and flat concrete upper panels 22, these panels 20 and 22 being disposed one atop the other in abutting relationship.

Preferably, the columns 12, 14 and the panels 20, 22 are formed of portland concrete and reinforcing steel, the concrete panels and posts having a minimum compressing strength of 4,000 psi and an air content of 7.0%, ±2%. The reinforcing steel should be ASTM A615, grade 60, wire. A minimum of one and one-half inch concrete cover should be provided over the reinforcing steel. The panels 20, 22 and the columns 12, 14 are formed by the wet cast method. In this embodiment, the posts or columns 12, 14 are set at twelve foot, zero inch spacing. The height of the columns 12, 14 varies as required for a particular application. In the preferred embodiment, the panels are of varying height, but are all of a width(a), of eleven feet, three inches and a thickness of four inches. These are designed to sustain a 33 psf wind loading and to distribute a maximum allowable passive soil pressure of 300 psf. The columns 12, 14 are all approximately fourteen inches in width and sixteen inches in depth.

The panels and columns preferably have a decorative surface texture on one or both sides, to produce an aesthetically pleasing appearance and also to help deaden noise levels by absorbing sound energy.

As further shown in FIG. 1, the lower panel 20 has a step or offset 24 at the midpoint of its lower edge, that is, the edge in contact with the soil. This step has a vertical offset of one foot, zero inches, and permits the panel 20 to be employed on terrain on which the surface level changes, and yet provide a flat bottom surface on either side of the step 24 to bear down vertically on the soil where there is an elevational change. This avoids producing an edgewise or horizontal component of force. The flat concrete upper panel 22 here has a slopingly rising top edge, which rises a distance (b), here one foot, zero inches.

As further shown in FIG. 1, at least some of the panels can be provided as a rectangular, unstepped lower panel **20*a* and rectangular, unstepped upper panel 22*a*, a lower panel 22*b* having steps 24 at both its lower and upper edges, an upper panel 22***b* having a slopingly rising upper edge and a step 26 at the midpoint of its lower edge, a lower panel 20*c* having a sloping lower edge and a step 28 at the midpoint of a horizontal upper edge, or a panel 22*c* having a level, unstepped top edge and a step 30 in a horizontal bottom edge. Also, for example, the bottom panel 20*d* could be provided with steps 32 in both top and bottom edges such that one edge thereof is longer than the other. An upper panel 22*d* can be provided with a sloping section of width (c) between level edge sections (d), in this embodiment, nine feet, three inches and one foot, zero inches, respectively.

It should be appreciated that the steps 24, 26 and 32, between the lower and upper panels permit them to mate with one another to form a stable panel structure having vertical stability and also having an aesthecticly pleasing appearance.

Figure 2:
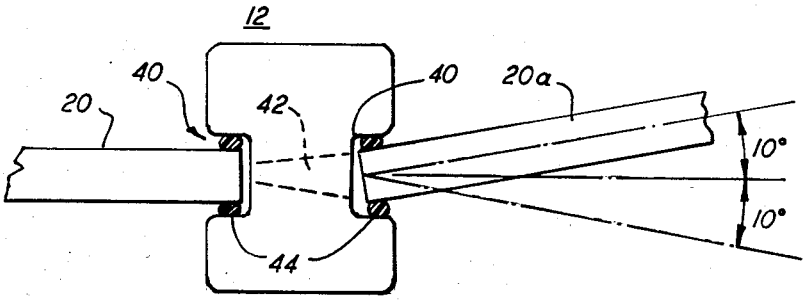
FIG. 2 is a top view showing one post or column employed in this embodiment.

FIG. 2 basically shows the column 12 in its relationship with its associated panels 20 and 20*a*. Here the column 12 has a generally rectangular cross section, but with chamferred corners and longitudinal recesses 40 slightly wider than the width of the associated panels 20 and 20*a*. Here, the longitudinal recesses 40 have a width of about four and three-quarter inches, the thickness of the panels 20 and 20*a* being about four inches. A butyl rubber compression seal 44 is provided at the contact point of the edge of the panels 20 and 20*a* with the respective recesses 40. These elements, in combination, permit an angular rotation of the panels 20*a* over a vertical axis to maximum deviations of about 10 degrees, as indicated in chain line in FIG. 2, with respect to a dead-center or undeviated orientation, shown in broken line. This structure will accommodate rotations of up to 10 degrees on either side of the center line.

One or more tapered lift holes 42 are provided extending through the column 12 from one of the recesses 40 to the other. This structure permits lifting of the column with a crane or the like to facilitate installation.

The panels 20, 22, etc. are handled and transported in the vertical position. Quick lifting devices are cast into the top edge and one side of the panels for lifting and erection.

Figure 3:
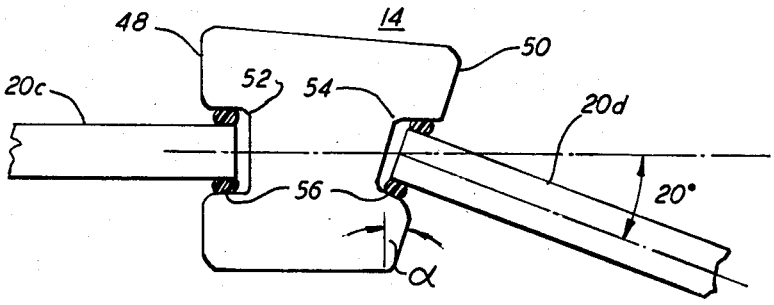
FIG. 3 is a top view showing another post or column employed in this embodiment.

As shown in FIG. 3, the post or column 14 for accommodating directional changes in the fence 10 can be formed with a generally trapezoidal cross section, with one lateral side 48 being out of parallel with its opposite side 50 by a desired offset angle $\alpha$, with $\alpha$ being selected greater than zero but less than a right angle. In this embodiment, the angle $\alpha$ is about 20 degrees. Longitudinal recesses or grooves 52 are formed on these lateral sides 48, 50 to receive the edges of associated panels 20*c* and 20*d*, and butyl rubber compression seals 56 are provided for generally the same function as the similar elements in FIG. 2. As with the previously described column 12, the structure of the column 14 of FIG. 3 does provide some angular play in the angular position of the panel 20*d* relative to the associated vertical recess 54. Thus, the column of FIG. 3 will accommodate angular changes in the direction of the fence from about 10 degrees to about 30 degrees.

While a preferred embodiment of this invention has been described, it should be understood that the invention is not limited to that particular embodiment. For example, the steps 24, 26, 28, 30, 32 can occur other than at the midpoints of the upper or lower edges of the panels 20, 22, etc., and there can be more than one step provided on the panel edges, if desired. Further, the steps can be of any desired size, such as six inches, nine inches, fifteen inches, etc.

Still further, the post-and-panel noise barrier fence structure of this invention is not limited to a roadway environment, but can be suitably adapted for other applications, as needed, without departing from the scope and spirit of this invention.

I claim:

1. A concrete post-and-panel noise barrier comprising a plurality of flat reinforced concrete panels each having a pair of parallel vertical side edges defining a width of the panel, a top edge, a bottom edge, and a predetermined thickness; and a plurality of reinforced concrete columns each having a pair of generally oppositely disposed longitudinal recesses each slightly wider than the thickness of said panels, with each said panel being mounted in cooperating longitudinal recesses in successive ones of said columns; and wherein at least certain ones of said panels have a step formed in one of said top and bottom edges with said one edge being generally horizontal and said step defining an offset such that one portion of said one edge adjacent said step is lower than the abutting portion of said one edge.

2. A concrete post-and-panel noise barrier according to claim 1, wherein said step is located at the midpoint of said one edge.

3. A concrete post-and-panel noise barrier according to claim 2, wherein pairs of said panels are disposed between successive ones of said columns, with at least certain pairs having a lower panel with the step in its top edge and an upper panel with the step in its bottom edge, said lower panel top edge and upper panel bottom edge mating with one another.

4. A concrete post-and-panel noise barrier according to claim 1, wherein said columns are generally a quadrilateral in cross section, with said longitudinal recesses being formed in opposed sides of the quadrilateral.

5. A concrete post-and-panel noise barrier according to claim 4, wherein said columns include one or more lift holes extending through the column from one of the opposed recesses to the other.

6. A concrete post-and-panel noise barrier according to claim 5, wherein said lift holes are tapered.

7. A concrete post-and-panel noise barrier according to claim 1, further comprising resilient sealing means disposed at each said recess for sealably engaging the respective side edge of the associated panel.

8. A concrete post-and-panel noise barrier comprising a plurality of flat reinforced concrete panels each having a pair of parallel vertical side edges defining a width of the panel, a top edge, a bottom edge, and a predetermined thickness; and a plurality of reinforced concrete posts each having a pair of generally oppositely disposed longitudinal recesses each slightly wider than the thickness of said panels, with each said panel being mounted in cooperating longitudinal recesses of successive ones of said columns; and wherein at least certain ones of said posts have said generally oppositely disposed recesses angled from each other by an angular offset of greater than zero degrees but less than a right angle so as to accommodate directional changes at said columns in the placement of said barrier.

9. A concrete post-and-panel noise barrier according to claim 8, wherein said panel is generally a trapezoid in cross section, with said recesses formed in oppositely disposed sides of the trapezoid; said oppositely disposed sides being out of parallel by said angular offset.

10. A concrete post-and-panel noise barrier according to claim 8, wherein said panels are rotatably adjustable, relative to the mating recess of the columns, over an angular range of about 10 degrees to either side of a central position.

* * * * *